US011493270B2

(12) United States Patent
Prosser et al.

(10) Patent No.: US 11,493,270 B2
(45) Date of Patent: Nov. 8, 2022

(54) DUAL MODE LIQUEFIED NATURAL GAS (LNG) LIQUEFIER

(71) Applicants: Neil M. Prosser, Lockport, NY (US); Richard M. Kelly, East Amherst, NY (US); Aditya Vaze, Williamsville, NY (US)

(72) Inventors: Neil M. Prosser, Lockport, NY (US); Richard M. Kelly, East Amherst, NY (US); Aditya Vaze, Williamsville, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 358 days.

(21) Appl. No.: 16/874,204

(22) Filed: May 14, 2020

(65) Prior Publication Data

US 2020/0370822 A1 Nov. 26, 2020

Related U.S. Application Data

(60) Provisional application No. 62/852,534, filed on May 24, 2019.

(51) Int. Cl.
*F25J 1/02* (2006.01)
*F25J 1/00* (2006.01)

(52) U.S. Cl.
CPC ..... *F25J 1/0022* (2013.01); *F25J 1/0279* (2013.01)

(58) Field of Classification Search
CPC ..... F25J 1/0022; F25J 1/0072; F25J 1/0042; F25J 1/0052; F25J 1/0057; F25J 2270/12; F25J 2270/904; F25J 2215/60
See application file for complete search history.

(56) References Cited

U.S. PATENT DOCUMENTS

| | | | | |
|---|---|---|---|---|
| 3,400,547 | A | 9/1968 | Williams et al. | |
| 4,606,741 | A | 8/1986 | Moreau et al. | |
| 5,950,453 | A * | 9/1999 | Bowen | F17C 3/025 62/623 |
| 2006/0213223 | A1* | 9/2006 | Wilding | F28D 7/0066 62/613 |
| 2011/0036121 | A1* | 2/2011 | Roberts | F25J 1/0279 62/620 |
| 2016/0003527 | A1* | 1/2016 | Dean | F25J 1/0231 62/614 |
| 2016/0131115 | A1* | 5/2016 | Uptigrove | F25J 1/0022 62/611 |
| 2018/0292128 | A1* | 10/2018 | Degenstein | F25J 1/0267 |

FOREIGN PATENT DOCUMENTS

| | | | |
|---|---|---|---|
| CN | 201532077 | U | 7/2010 |
| DE | 102011115987 | A1 | 4/2013 |

* cited by examiner

*Primary Examiner* — Brian M King
(74) *Attorney, Agent, or Firm* — Robert J. Hampsch

(57) ABSTRACT

A dual-mode LNG liquefier arrangement that is configurable to operate in a first mode broadly characterized as a low pressure, liquid nitrogen add LNG liquefier without turbo-expansion or a second mode broadly characterized as a low pressure, liquid nitrogen add LNG liquefier with turbo-expansion.

17 Claims, 7 Drawing Sheets

DUAL MODE LIQUEFIED NATURAL GAS (LNG) LIQUEFIER

CROSS REFERENCE TO RELATED APPLICATIONS

This application claims the benefit of and priority to U.S. provisional patent application Ser. No. 62/852,534 filed May 24, 2019; the disclosure of which is incorporated by reference herein.

TECHNICAL FIELD

The present invention relates to production of Liquefied Natural Gas (LNG), and more particularly, to a small scale or micro-scale, nitrogen refrigeration LNG production system suitable for use in a distributed LNG production environment.

BACKGROUND

Demand and recognition for both LNG production and LNG use applications within the energy, transportation, heating, power generation and utility sectors is rapidly increasing, as the use of LNG as a lower cost, alternative fuel also allows for a potential reduction in carbon emissions and other harmful emissions such as Nitrogen oxides (NOX), Sulfur oxides (SOX), and particulate matter which are generally recognized as detrimental to air quality.

One such LNG production application is flare gas capture as many energy companies are seeking means to reduce flaring of methane gas associated with crude oil and bitumen production through purification and liquefaction of the gas by-products, and subsequent distribution of the resulting LNG by means of over-the-road or maritime transport or on-site use of the LNG fuel. In 2017 alone, the United States Energy Information Administration (EIA) reported that over 235 billion cubic feet of natural gas was vented and/or flared, which essentially discarded a very valuable resource from the national oil and gas supply chain.

In areas where there is little to no access to natural gas pipeline distribution networks, a new trend has emerged for distributed LNG production which involves construction and operation of smaller LNG plants or production systems built in regions where attractive sources of low cost natural gas or methane biogas are available and there is a current demand for LNG or the demand is expected to grow over time. With such small scale LNG production, stranded gas resource owners can monetize their natural gas assets which could not be connected to a natural gas pipeline network. Such small scale LNG production may also economically enable or further enhance crude oil production in certain regions that have no pipeline infrastructure which can gather the associated gas produced with the oil. Other distributed LNG opportunities include oil well seeding, LNG supply at compressed natural gas filling stations, LNG production from biogas sources such as landfills, farms, industrial/municipal waste and wastewater operations, etc.

Most conventional small scale or micro-scale LNG production systems target a production of between 5,000 gallons per day (0.4 MMSCFD) to 15,000 gallons per day (1.2 MMSCFD) of LNG and employ mechanical refrigeration to cool to the collected gas to subzero temperatures required for natural gas liquefaction. Two examples of small scale or micro-scale mechanical-based refrigeration solutions on the market are the LNGo™ Micro-scale LNG Production System offered by Siemens Dresser Rand and the Cryobox® LNG-Production Station, designed and manufactured by Galileo.

Disadvantages with these mechanical-based refrigeration LNG production systems for small-scale LNG production, compared to nitrogen refrigeration based LNG production systems include the relatively high capital cost of the mechanical-based refrigeration LNG production systems, the larger size/footprint and complexity of the mechanical-based refrigeration LNG production system, significant power consumption, high maintenance costs associated with the compression and refrigeration equipment in the mechanical-based refrigeration LNG production systems, and general lack of design flexibility during installation/commissioning as well as the system inefficiency, particularly during turndown operations.

While nitrogen refrigeration based liquefaction systems are well known and currently utilized for large-scale LNG production plants, the technology has not proven to be commercially feasible for small-scale or micro-scale LNG production. What is needed is a low capital cost nitrogen refrigeration based micro-scale LNG production system that is compact, modular, and movable yet provides design and cost flexibility in the configuration of the micro-scale LNG production system.

SUMMARY OF THE INVENTION

The present invention may be characterized as a dual mode natural gas liquefier, comprising: (i) a heat exchanger having a plurality of cooling passages and a plurality of warming passages, the heat exchanger configured to liquefy the gaseous natural gas traversing the cooling passages via indirect heat exchange with nitrogen traversing the warming passages; (ii) a natural gas inlet disposed on the heat exchanger and configured to receive a gaseous natural gas feed and distribute the natural gas through a plurality of cooling passages; (iii) a natural gas outlet disposed on the heat exchanger and configured to discharge the liquefied natural gas from the heat exchanger; (iv) a liquid nitrogen inlet disposed on the heat exchanger and configured to receive a liquid nitrogen feed and distribute the liquid nitrogen through a plurality of warming passages; (v) a gaseous nitrogen outlet disposed on the heat exchanger and configured to discharge the vaporized nitrogen from the heat exchanger; (vi) an intermediate outlet disposed on the heat exchanger and coupled to one or more of the plurality of warming passages and configured to divert a gaseous nitrogen stream passing through the one or more of the plurality of warming passages; (vii) a first intermediate inlet disposed on the heat exchanger and; (viii) a second intermediate inlet disposed on the heat exchanger.

The presently disclosed dual mode natural gas liquefier is configured to operate in a first mode or a second mode. When operating in the first mode, the intermediate outlet is in fluid communication with the first intermediate inlet and the diverted gaseous nitrogen stream is reintroduced to warming passages within the heat exchanger via the first intermediate inlet with the reintroduced nitrogen stream at a temperature that is equal to or greater than the temperature of the diverted gaseous nitrogen stream. On the other hand, when the dual mode natural gas liquefier is configured to operate in the second mode, the intermediate outlet is in fluid communication with the second intermediate inlet and wherein the diverted gaseous nitrogen stream is expanded and the expanded nitrogen stream is reintroduced to warming passages within the heat exchanger via the a second intermediate inlet and the diverted gaseous nitrogen stream is reintroduced to warming passages within the heat exchanger via the first intermediate inlet with the reintroduced nitrogen stream at a temperature that is less than the temperature of the diverted gaseous nitrogen stream.

Also, when the dual mode natural gas liquefier is configured to operate in the second mode, it further includes a turbine configured to expand the diverted gaseous nitrogen stream and produce a turbine exhaust stream that is at a temperature that is less than the temperature of the diverted nitrogen stream. The turbine is preferably an air bearing turbine having an expansion ratio of between about 2.0 and 4.0. In addition, to isolate the nitrogen flows within the heat exchanger during the second mode, a cold end blind flange and a warm-end blind flange are installed. The cold-end blind flange fluidically isolates a first set of warming passages from a second set of warming passages within the warm heat exchanger and thereby prevent nitrogen exiting the cold heat exchanger to reach the second set of warming passages. The warm-end blind flange is disposed proximate the first intermediate inlet and is configured to prevent any flow of nitrogen from entering or exiting the heat exchanger via the first intermediate inlet.

The heat exchanger includes comprises two or more separate heat exchangers, including a cold heat exchanger and a warm heat exchanger. The warming passages of the cold heat exchanger are in fluid communication with warming passages of the warm heat exchanger and the cooling passages of the cold heat exchanger are in fluid communication with the cooling passages of the warm heat exchanger. In this two heat exchanger arrangement, the liquefied natural gas outlet and the liquid nitrogen inlet are disposed on the cold heat exchanger, whereas the natural gas inlet and the nitrogen outlet are disposed on the warm heat exchanger. Preferably, the warm heat exchanger is a brazed aluminum heat exchanger while the cold heat exchanger is a brazed stainless steel heat exchanger or a stainless steel spiral wound heat exchanger. Also, the second intermediate inlet is preferably disposed between the cold heat exchanger and the warm heat exchanger while the intermediate outlet and the first intermediate inlet are preferably disposed at an intermediate location of the warm heat exchanger.

Compared to conventional small-scale LNG plants with mechanical refrigeration, use of the present dual mode LNG liquefier in the LNG plant could be expected to result in a lower overall capital cost for the LNG plant of the scale typically required for capturing flare gas volumes in the range of about 0.4 to 1.5 MMSCFD There are at least two distinguishing and advantageous features of the present small-scale LNG production system with liquid nitrogen refrigeration. First, the small-scale LNG production system with liquid nitrogen refrigeration is designed or configured to function in dual modes, including a first mode without a turbine or a second mode with a turbine. The heat exchanger arrangement and associated piping in the dual mode LNG liquefier will be able to accommodate either configuration with little to no design changes. In that way, depending on the parameters for a given project opportunity and the regional cost of liquid nitrogen, an LNG liquefier design without a turbine or an LNG liquefier design with a turbine can be selected. The fixed or common heat exchanger arrangement thus enables a more flexible offering at a likely lower installed cost for a given project and facilitates a predictable and fast project schedule. The present dual mode LNG liquefier design further enables a compact, drop-in cold box design for any project opportunity. A second advantageous feature is the LNG liquefier capacity is such that when configured to operate in the second mode with a turbine, the turbine pressure and temperature conditions are selected so that a low cost, portable air bearing turbines can be employed.

BRIEF DESCRIPTION OF THE DRAWINGS

It is believed that the claimed invention will be better understood when taken in connection with the accompanying drawing in which:

DETAILED DESCRIPTION

A dual-mode LNG liquefier arrangement that is configurable to operate in a first mode or a second mode is provided. The first mode of operation is broadly characterized as a low pressure, liquid nitrogen add LNG liquefier without turbo-expansion while the second mode of operation is broadly characterized as a low pressure, liquid nitrogen add LNG liquefier with turbo-expansion. Advantageously, the dual mode LNG liquefier arrangement is configured or manufactured with the same fixed heat transfer surface area for both modes of operation. The design and installation flexibility offered by the dual-mode LNG liquefier arrangement facilitates the choice of the supplier or customer of whether or not to employ a turbine for the turbo-expansion of vaporized nitrogen in a small-scale LNG production process to achieve the best project economics.

When using the dual-mode LNG liquefier arrangement configured to operate in the second mode with the turbine, the initial capital costs associated with the are higher compared to the base LNG liquefier arrangement configured to operate in the first mode, due to the presence of the turbine. On the other hand, using the dual-mode LNG liquefier arrangement configured to operate in the first mode without the turbine requires potentially reduces the capital costs but requires additional liquid nitrogen to liquefy the same volume of natural gas. Generally speaking, the price of liquid nitrogen is very dependent on the location of the proposed installation site and the distance between the liquid nitrogen production source and the proposed installation site.

Also, as is well know in the art, the volume of liquid nitrogen required for liquefaction of natural gas depends on the surface area of the heat exchanger as well as the pressure of the natural gas feed, the natural gas composition, and ambient temperature. Of the natural gas supply conditions, the feed pressure will by far have the most effect on the liquid nitrogen required. For example, in either mode of operation, the total liquid nitrogen requirement is reduced about 5% to 6% if natural gas feed is supplied at a pressure of 500 psig compared to 100 psig. Increasing the natural gas feed pressure can easily be accomplished, but may require the capital purchase and installation of a natural gas compressor which negatively impacts the project economics.

Figure 1:
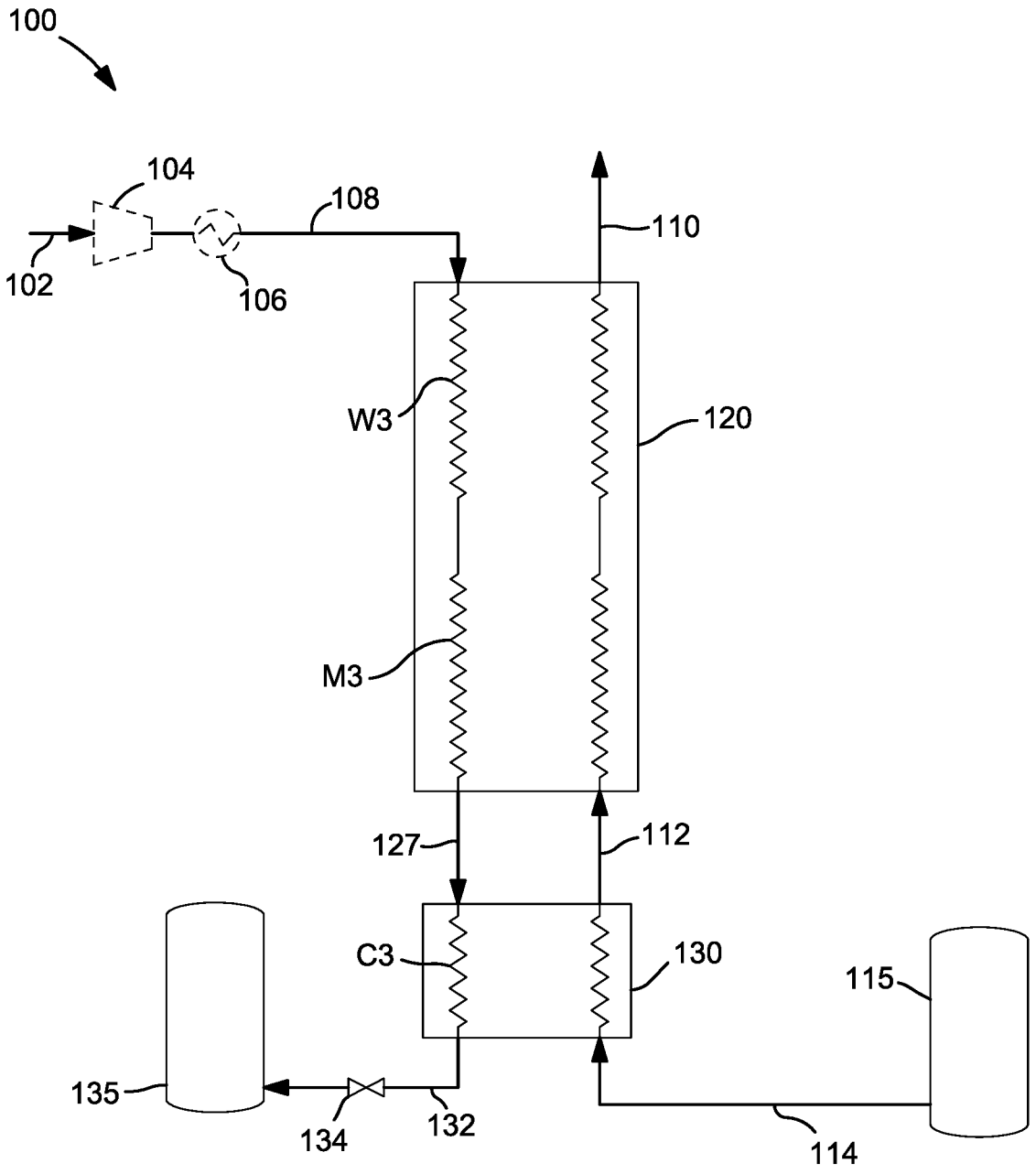
FIG. 1 shows a schematic flow diagram of the dual-mode LNG liquefier with liquid nitrogen refrigeration configured to operate in a first mode, that liquefies the natural gas feed without use of supplemental refrigeration from a turbo-expander.

Turning now to the drawings, FIG. 1 shows a schematic flow diagram of the dual-mode LNG liquefier arrangement 100 configured to operate in the first mode, without a turbine and without turbo-expansion of the vaporized nitrogen. In this embodiment, a stream of liquid nitrogen 114 is preferably supplied from a storage tank 115 or other source of liquid nitrogen at no less than about 55 psia so that the liquid nitrogen is at a temperature sufficiently warm to avoid freezing the liquefied natural gas. Due to a large difference between the condensing temperature of the natural gas and the boiling temperature of nitrogen, a brazed aluminum heat exchanger (BAHX) cannot be used for natural gas liquefaction and subcooling. The likely alternative is use of a brazed stainless steel heat exchanger (BSSHX) for the cold end of heat exchanger arrangement, although a stainless steel spiral wound heat exchanger is also a viable selection.

As seen in FIG. 1, the heat exchanger arrangement is preferably comprised of two sections, including a cold section 130 having heat exchange passages C1 and C3 that are in a BSSHX and a warmer section 120 that is a BAHX having heat exchange passages M1, W1, M3, and W3. Heat exchange passages C1 is configured to receive the liquid nitrogen stream 114 at a nitrogen inlet of the BSSHX 130 and produce a nitrogen effluent stream 112 at a nitrogen outlet of the BSSHX 130. Heat exchange passages M1 and W1 are disposed in the BAHX 120 and configured to receive effluent stream 112 from the BSSHX 130 at an intermediate inlet and produce a vaporized nitrogen stream 110 at the nitrogen outlet. The illustrated heat exchanger arrangement is further configured to receive a natural gas feed 102 that may be optionally compressed in compressor 104 and cooled in aftercooler 116 to produce a conditioned natural gas feed 108 that is introduced to the BAHX 120 at the natural gas inlet. The conditioned natural gas feed 108 is cooled in heat exchange passages W3 and M3 in the BAHX 120 to produce a cooled natural gas stream 127 taken at an intermediate outlet of the BAHX 120 and directed to an inlet of the BSSHX 130 and specifically in heat exchange passage C3 where the natural gas is liquefied via indirect heat exchange against the liquid nitrogen stream 114 to produce a liquefied natural gas stream 132 that may be let down in pressure in expansion valve 134 and stored in tank 135.

The illustrated heat exchanger arrangements are designed and configured such that only the heat duty that is necessary for liquefaction of the natural gas is performed in the BSSHX, since the heat transfer surface cost in the BSSHX is typically higher than that of the BAHX. This means that almost all the liquefaction and all the liquid subcooling of the natural gas takes place in the cold section, or the BSSHX while the majority of the heat transfer surface area is included in the BAHX.

From a design perspective, only minor amounts of heavier hydrocarbons (i.e. heavier than methane) may condense in the warmer section or BAHX portion of the heat exchanger arrangement. A modest amount of natural gas vapor subcooling also takes place in the cold section or BSSHX. This is necessary because it ensures that vaporized nitrogen is sufficiently warmed before exiting the BSSHX and any unacceptably high temperature differences in the BAHX are avoided.

Figure 2:
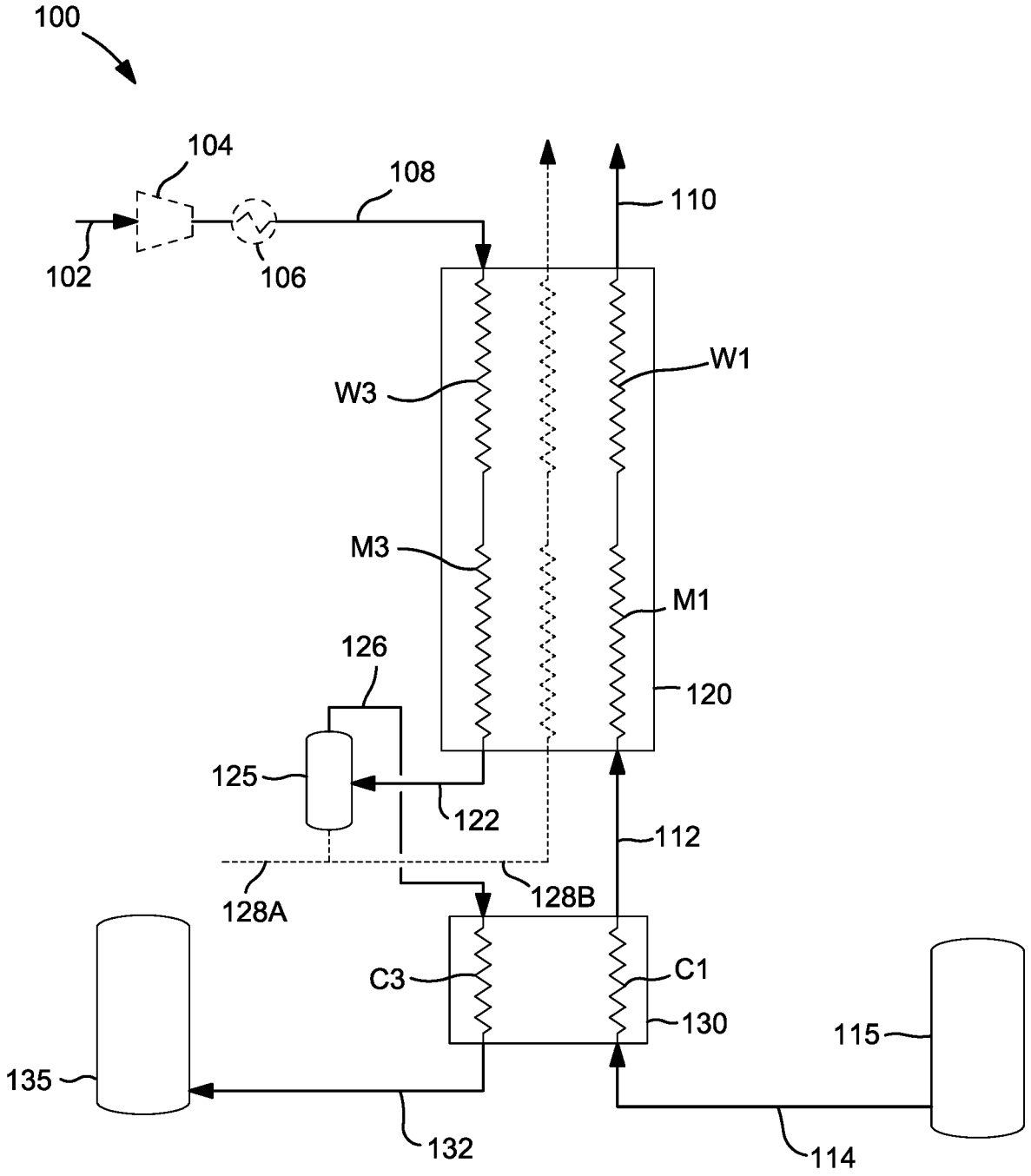
FIG. 2 shows a schematic flow diagram of an alternate embodiment of the dual-mode LNG liquefier with liquid nitrogen refrigeration configured to operate in a first mode, that liquefies the natural gas feed without use of supplemental refrigeration from a turbo-expander.

An alternate embodiment of the present LNG liquefier arrangement is shown in FIG. 2. Many of the components in the LNG liquefier arrangement shown in FIG. 2 are similar or identical to those described above with reference to FIG. 1 and for sake of brevity will not be repeated. The differences between the embodiment of FIG. 2 compared to the embodiment shown in FIG. 1 is the addition of a NGL removal circuit. In some cases, preprocessing of the natural gas to remove natural gas liquids (NGL) is performed before the feed stream enters the LNG liquefier supply pipeline. It is important to remove the NGL in order to avoid freezing of the heavier components in the cold section. If the NGL have not been removed in an upstream operation, the such removal of the NGL should occur prior to entry into the BSSHX as shown in FIG. 2. In this embodiment, the natural gas stream 122 exiting the BAHX 120 is diverted to a separator 125 which is configured to remove the NGL. The cooled, purified natural gas stream 126 is directed to the BSSHX 130 while the removed NGL stream could be drained to provide a subsidiary product stream 128A or if they are to be recovered or otherwise used locally as a fuel, the separated NGL stream 128B could be rewarmed in the BAHX 120.

Figure 3:
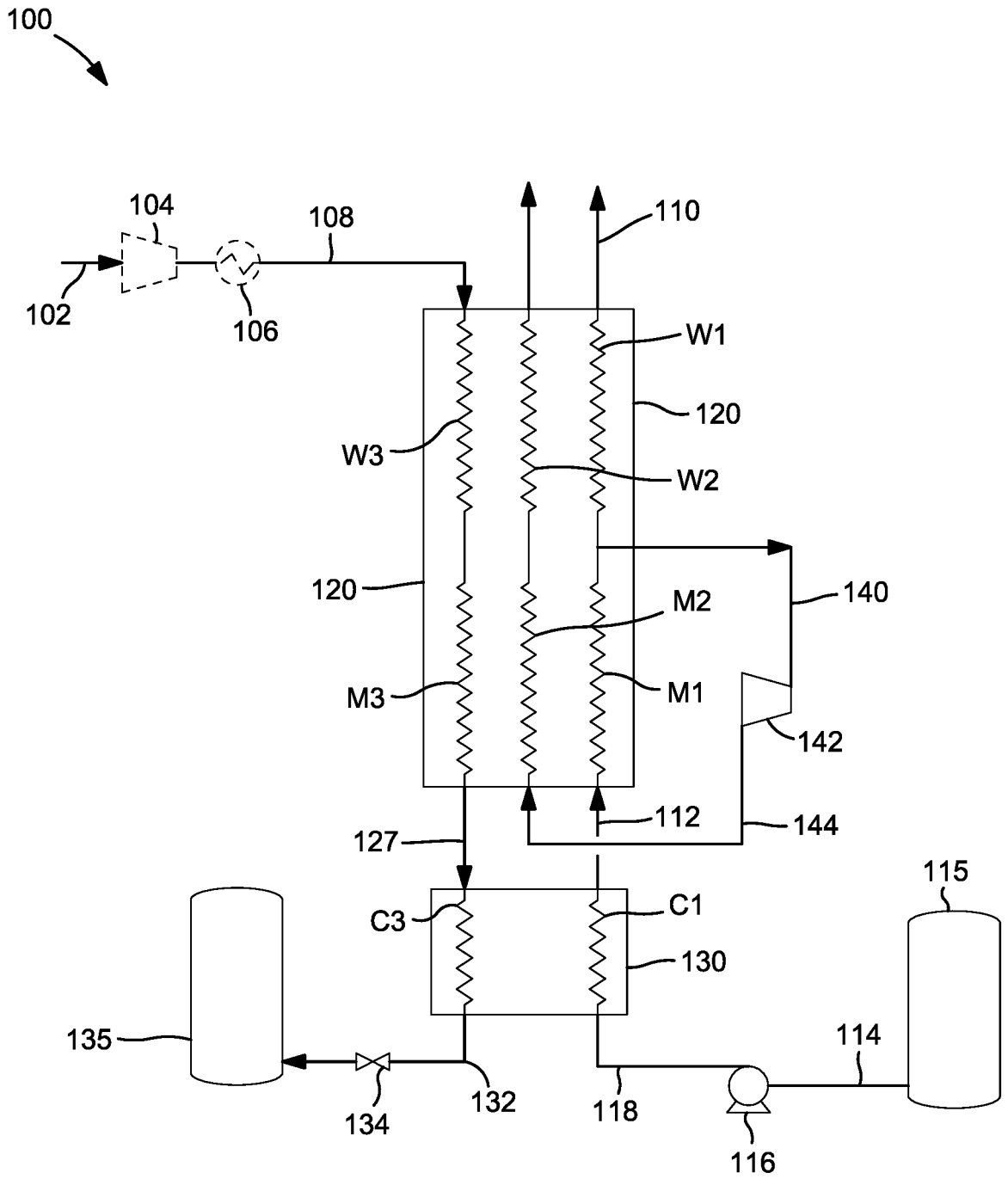
FIG. 3 shows a schematic flow diagram of a dual-mode LNG liquefier with liquid nitrogen refrigeration configured to operate in a second mode, that liquefies the natural gas feed with use of supplemental refrigeration from a turbo-expander.

Turning now to FIG. 3, there is shown a schematic flow diagram of the dual-mode LNG liquefier arrangement configured to operate in the second mode. Again, as many of the components in the LNG liquefier arrangement shown in FIG. 3 are similar or identical to those described above with reference to FIG. 1, the descriptions thereof will not be repeated. The difference between the embodiment of FIG. 3 compared to the embodiment shown in FIG. 1 is the addition of a turbine 142 configured to expand all or a portion of the vaporized nitrogen stream 140 extracted from an intermediate location of the BAHX 120, preferably between heat exchange passages M1 and W1.

By employing a turbine at the proper temperature level, extra refrigeration is supplied to the LNG production system at the temperature where it is needed above the liquid nitrogen boiling zone. This, in turn, then relieves the intermediate temperature pinch so that liquid nitrogen consumption is reduced compared to the first mode of operation described above with reference to FIG. 1, and the warm end temperature difference in the heat exchanger arrangement can be reduced to a practical minimum in this embodiment.

As indicated above, the vaporized nitrogen stream 140 is extracted from an intermediate location of the BAHX 120 expanded in the turbine 142 and the turbine exhaust 144 is returned to the BAHX 120 proper location. Preferably, the heat exchanger arrangement is designed such that the turbine exhaust 144 is returned at a location that is at the break point between the BSSHX 130 and the BAHX 120. The turbine exhaust 144 is then warmed in heat exchange passages M2 and W2 and exits the BAHX 120 as a vaporized nitrogen stream 145.

In the embodiment of FIG. 3, vaporized nitrogen stream 140 extracted from an intermediate location of the BAHX 220 is preferably at a pressure selected to enable the desired turbo-expansion, preferably between about 50 psia and about 150 psia, and more preferably between about 50 psia and about 100 psia. To achieve this desired pressure, the pressure of the liquid nitrogen stream 114 may be raised using a dedicated pump 116 or simply by operating the liquid nitrogen storage tank 115 at an elevated pressure. When using a dedicated pump, the higher pressure liquid nitrogen stream 118 feeding the cold section of the heat exchanger or the BSSHX 130 will be subcooled, whereas if the liquid nitrogen storage tank 115 pressure is elevated the liquid nitrogen feed is preferably a warmer saturated liquid. So, using a pump 116 will reduce the overall liquid nitrogen consumption, but introduces additional costs and complexities.

Figure 4A:
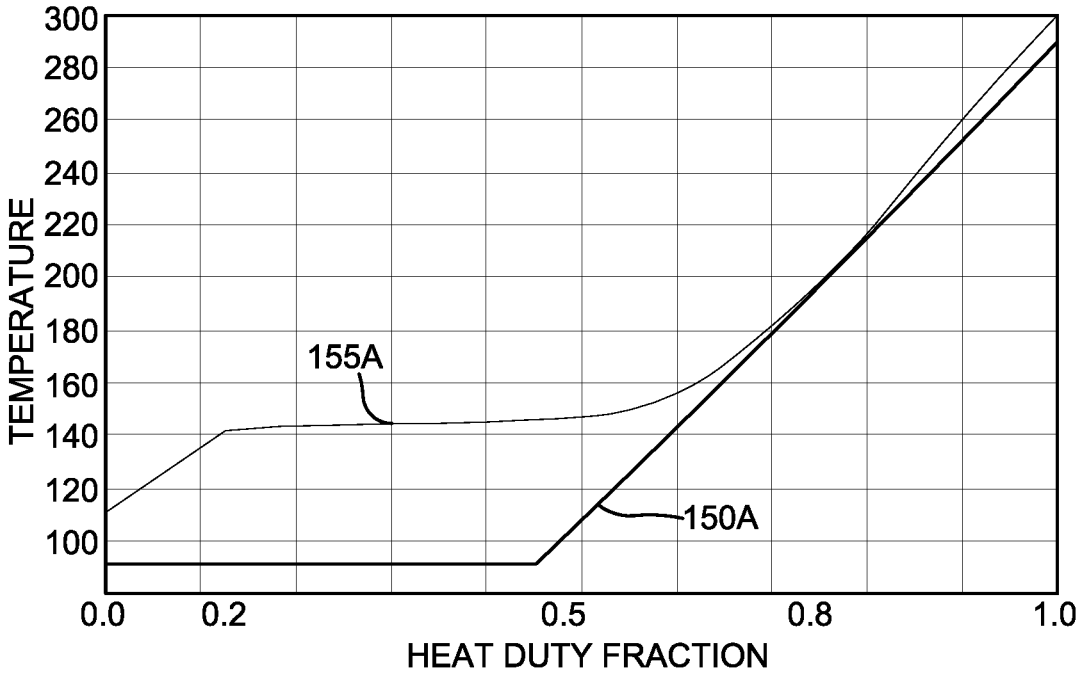
FIGS. 4A and 4B are graphical illustrations of the temperature profiles of the respective streams in the dual-mode LNG liquefier, with FIG. 4A showing temperature profile of the first mode and FIG. 4B showing the temperature profile of the second mode.
Figure 4B:
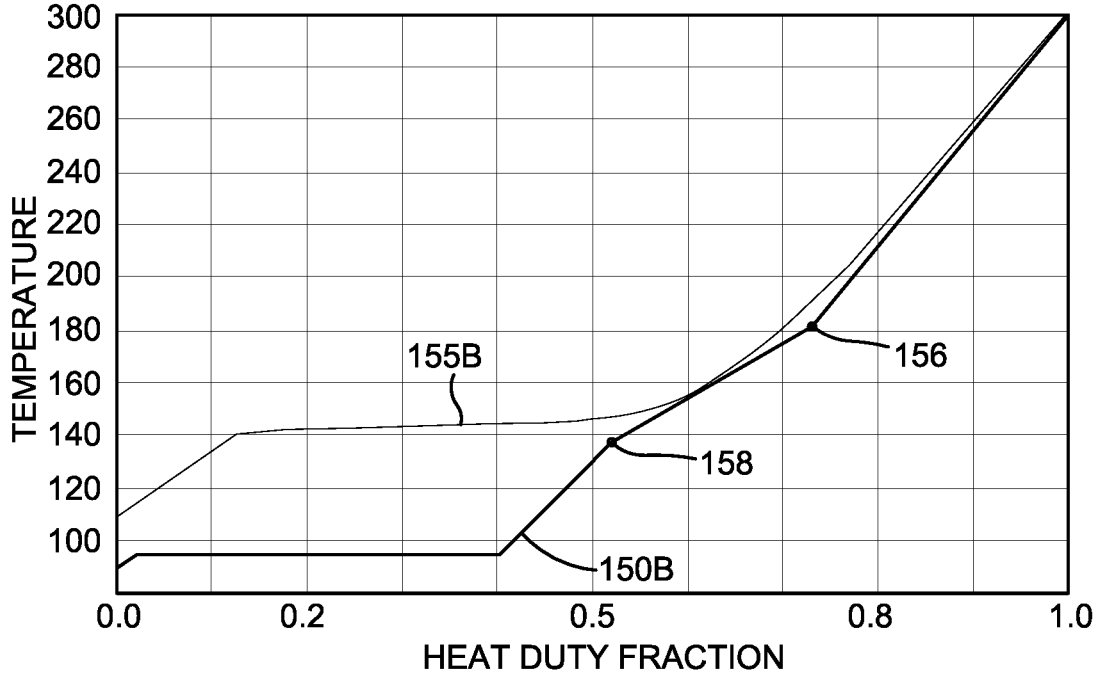

FIGS. 4A and 4B are graphical illustrations of the temperature profiles of the respective streams in the dual-mode LNG liquefier, with FIG. 4A showing temperature profile of the first mode and FIG. 4B showing the temperature profile of the second mode. Curves 150A and 155A represent the temperature profiles of the warming nitrogen and the cooling natural gas, respectively as a function of the heat duty fraction in the first mode of operation whereas curves 150B and 155B represent the temperature profiles of the warming nitrogen and the cooling natural gas, respectively as a function of the heat duty fraction in the second mode of operation, with turbo-expansion of the warming nitrogen stream.

Comparing the temperature profiles shown in FIGS. 4A and 4B highlights the benefit that the second mode of operation gives compared to the first mode of operation. Specifically, the reduced slope in the warming nitrogen temperature profile 150B in FIG. 4B is indicative of the zone where extra refrigeration is provided by the turbine. Point 156 represents the intermediate location where the vaporized nitrogen stream 140 extracted from the warmer section of the BAHX 120 while point 158 represents the location where the turbine exhaust is reintroduced to the BAHX 120. As a result, the nitrogen flow needed for the lower refrigeration demand zones above the turbine (i.e. above points 156 and 158) and below the turbine (i.e. below points 156 and 158) can be reduced. Natural gas compression is generally optional for all configurations and modes of operation. If natural gas compression is used, the resultant liquid nitrogen reduction is additive to the liquid nitrogen reduction provided by the turbo-expansion of the warming nitrogen stream.

While the addition of the turbine 142 clearly reduces the liquid nitrogen consumption in the disclosed LNG production system, it is essential that the second mode of operation is configured to operate in an economically effective manner. In the preferred embodiments, the turbine inlet pressure of the second mode of operation preferably ranges from about 50 psia to about 100 psia, although it may be as high as about 150 psia. The turbine outlet pressure preferably ranges from about 15 psia to about 30 psia. The warmed nitrogen exhaust stream 144 from the turbine may be vented to the atmosphere or used in a pre-processing or post-processing step such as for natural gas purifier regeneration.

For example, in some applications the natural gas feed stream is purified in a pre-process step using a thermal swing adsorption (TSA) bed to reduce the concentrations of impurities, namely $CO_2$ and $H_2O$ to below 50 ppm and 1 ppm, respectively. One can use the vaporized nitrogen exiting the dual mode liquefier to purge and regenerate the molecular sieve beds of the TSA. This would represent an improvement over the conventional technique of using cleaned natural gas, as embodied in many conventional small-scale LNG production systems. Use of the vaporized nitrogen to purge and regenerate the molecular sieve beds of the TSA significantly reduces the volume of hydrocarbons that would otherwise be vented or flared.

An air bearing turbine is the preferred choice for the turbine used in the second mode, primarily because of its low cost. An air bearing turbine also has the important benefit of no lube oil system, which is more conducive to a compact and portable design when the turbine is added. The energy of expansion from the turbine may be dissipated using an air blower without the need to couple the turbine to external utilities. Alternatively, an oil brake or electric generator could be used, but these would require connections to externally supplied utilities that would impede a compact and portable design, that could be mounted on a flatbed trailer to facilitate portability.

Figure 5A:
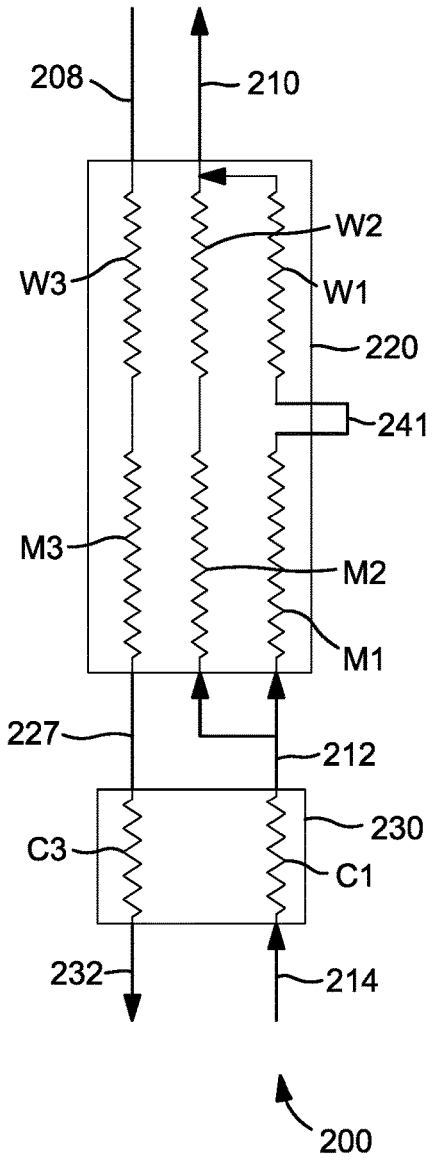
FIGS. 5A and 5B conceptually depict schematic flow diagrams of the dual-mode LNG liquefier arrangement with common heat exchanger arrangement, operating in the first mode (FIG. 5A) or a second mode (FIG. 5B)
Figure 5B:
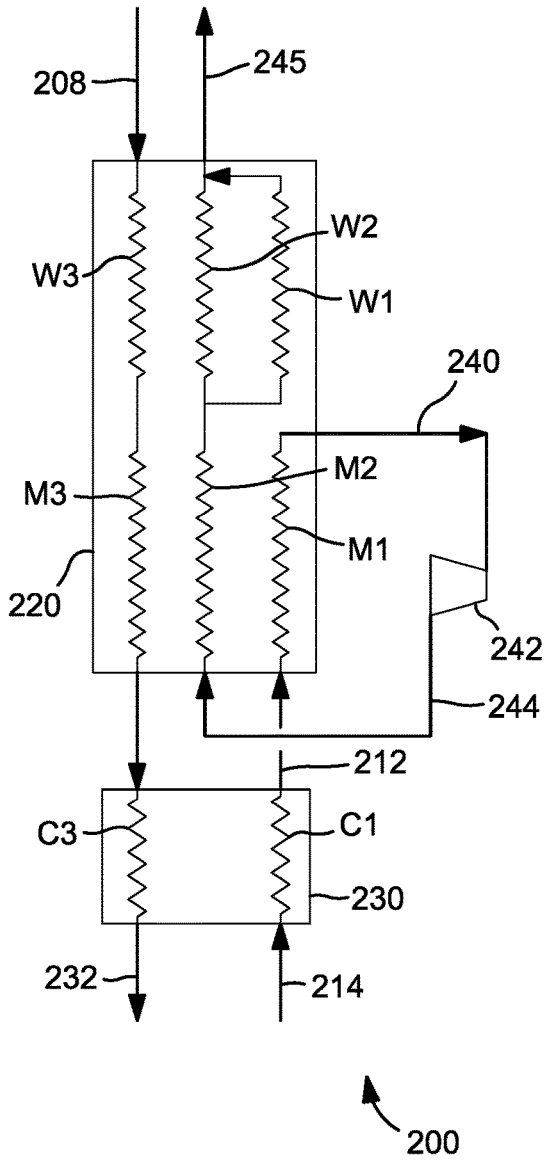

Turning now to FIGS. 5A and 5B, schematic flow diagrams of an alternate embodiments of the dual-mode LNG liquefier arrangement 200 are shown with a fixed or common heat exchanger arrangement. FIG. 5A conceptually depicts the natural gas and liquid nitrogen flow paths when the fixed or common heat exchanger arrangement is configured to operate in the first mode while FIG. 5B conceptually depicts the respective flow paths when the fixed or common heat exchanger arrangement is configured to operate in the second mode.

As seen in FIG. 5A, the illustrated embodiment of the heat exchanger arrangement or liquefier 200 is also preferably comprised of two sections, including a cold section or BSSHX 230 having heat exchange passages C1 and C3 and a warmer section BAHX 220 having heat exchange passages M1, M2, M3, W1, W2, and W3. Heat exchange passages C1 is configured to receive the liquid nitrogen stream 214 at a nitrogen inlet of the BSSHX 230 and produce a nitrogen effluent stream 212 at a nitrogen outlet of the BSSHX 230. Heat exchange passages M1, M2, W1, and W2 are disposed in the BAHX 220 and configured to receive effluent stream 212 from the BSSHX 230 at an intermediate inlet and produce a vaporized nitrogen stream 210 at the nitrogen outlet. The illustrated heat exchanger arrangement is further configured to receive a conditioned natural gas feed 208 that is introduced to the BAHX 220 at the natural gas inlet. The conditioned natural gas feed 208 is cooled in heat exchange passages W3 and M3 in the BAHX 220 to produce a cooled natural gas stream 227 taken at an intermediate outlet of the BAHX 220 and directed to an inlet of the BSSHX 230 and specifically in heat exchange passage C3 where the natural gas is liquefied via indirect heat exchange against the liquid nitrogen stream 214 to produce a liquefied natural gas stream 232.

As seen in FIG. 5B, the turbine takeoff or extraction point for the turbine stream 240 is located at an intermediate location of the BAHX 220. The extracted turbine stream 240 is expanded in turbine 242 with the resulting turbine exhaust stream 244 returned to an inlet of the BAHX 220, preferably to heat exchange passage M2 and continuing on through heat exchange passages W1 and W2. The preferred location of the extraction point for the turbine stream 240 is ascertained based on the UA values chosen for the common design, as generally taught in the examples below. The turbine exhaust stream 244 is returned to the inlet disposed at a location that is preferably at the break point between the BSSHX 230 and the BAHX 220. The exhaust stream 244 is used to cool the natural gas stream traversing the BAHX 220 via indirect heat exchange and exits from the nitrogen outlet of the BAHX 220 as stream 245.

In both embodiments illustrated in FIGS. 5A and 5B, the warming heat exchange passages M1, M2, W1 and W2 within the BAHX 220 through which the liquid and vaporized nitrogen traverse are apportioned, as required to maintain the highest utilization which should result in the most effective or efficient design. That is, any warming heat exchange passages that are simply not used in a design case will yield a potentially ineffective design. The substantial relative flows of each stream mean that heat exchanger layers that are not used in a mode would appreciably penalize the efficiency in that mode. In the embodiments shown in FIGS. 5A and 5B, all warming heat exchange passages M1, M2, W1 and W2 are utilized in both the first mode and the second mode.

In the second mode of operation utilizing a turbine 242, the warming turbine exhaust stream 244 is split at or near the extraction point so that all warming heat exchange passages, namely heat exchange passages W1 and W2 of the BAHX 220 are used. The desired distribution of the flow in the BAHX 220 will be such that the warm end temperatures of the streams in heat exchange passages W1 and W2 are nearly identical (i.e. minimal maldistribution).

In FIG. 5A, the warming vapor nitrogen exiting the BSSHX 230 must be distributed properly to the warming heat exchange passages within the BAHX 220 such that all passages, conceptually depicted as M1 and M2 are effectively utilized. Similar to the second mode of operation, the nitrogen stream in warming passages M2 is withdrawn or extracted from the BAHX and then promptly returned to the warming heat exchange passage depicted as W2. As a result, a proper distribution of the nitrogen vapor in M1 and M2 will yield very similar warm end temperatures of passages M1 and M2, as well as very similar warm end temperatures of passages W1 and W2.

The relative volume flows of the nitrogen and natural gas at the cold end of the BAHX 220 for the second mode of operation are shown in the Tables associated with the Examples, below. The lower pressure of the turbine exhaust stream compared to the nitrogen stream preferably translates to a volumetric flow of the turbine exhaust stream that is about four times (4×) greater than the nitrogen vapor flow from the BSSHX into the cold end of the BAHX. Also, the lower pressure of the turbine exhaust stream compared to the nitrogen stream means the costs associated or attributable to the pressure drop is greater for the turbine exhaust stream. From a design perspective, this realization would suggest using more heat exchange layers and/or lower pressure drop extended fins for the warming passages in M1.

Meanwhile, the distribution of the nitrogen vapor flows between warming passages W1 and W2 for the second mode of operation, as well as the distribution of the nitrogen vapor flows between warming passages M1 and M2 for the first mode of operation should be reasonably ideal. The importance and relevance of the lower pressure drop for the turbine exhaust stream compared to the other nitrogen vapor streams means it will be preferred for the turbine exhaust stream to use the centrally disposed headers and distributors within the BAHX, which generally enables lower pressure drops than peripherally located or other distributors.

Figure 6:
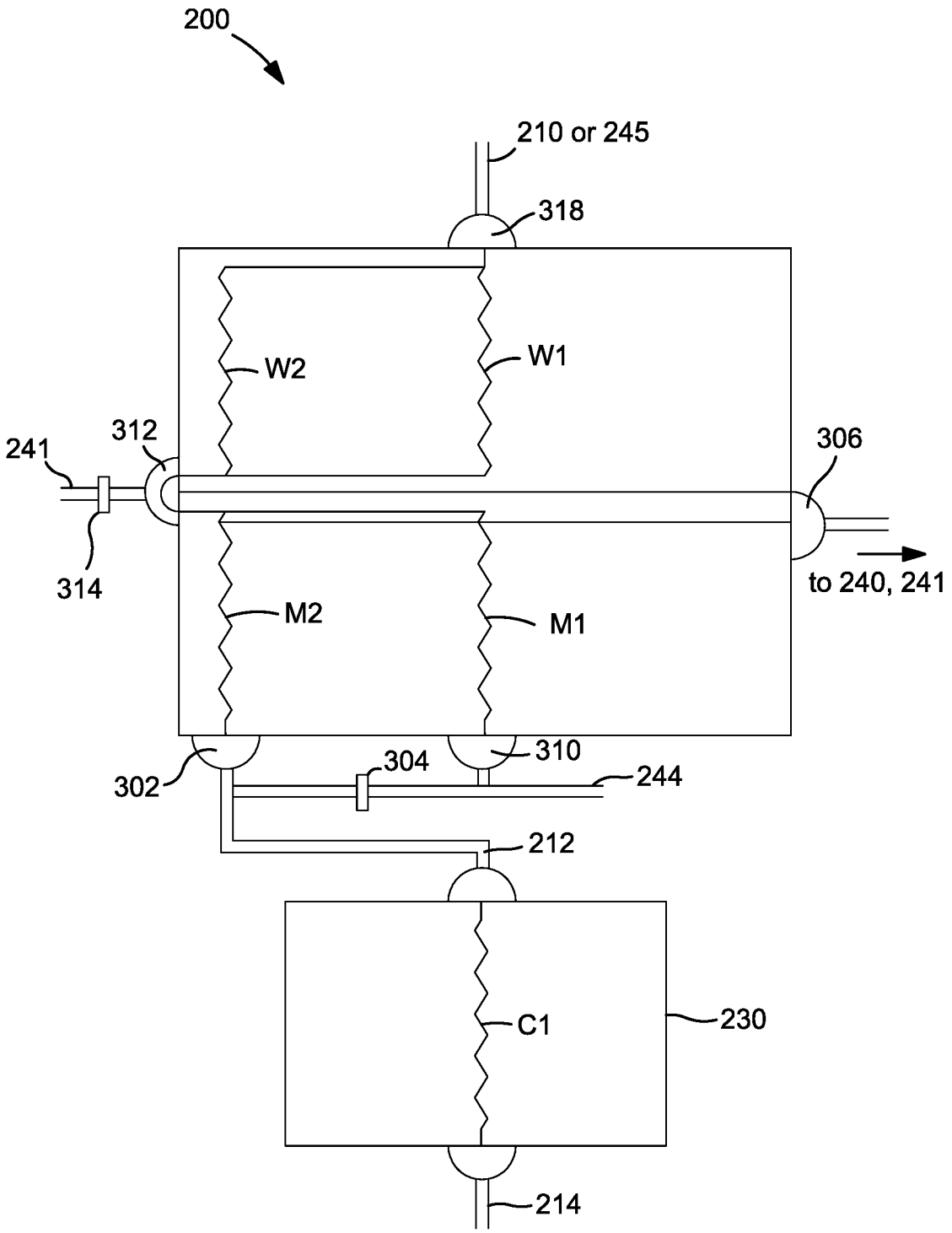
FIG. 6 conceptually depicts the physical arrangement of the flow paths for distributing the nitrogen flows in warming passages in the various modes of operation.

The physical arrangement of the flow paths and piping for distributing the nitrogen flows in warming passages in various modes of operation for the embodiments illustrated in FIGS. 5A and 5B are schematically depicted in FIG. 6.

Figure 7B:
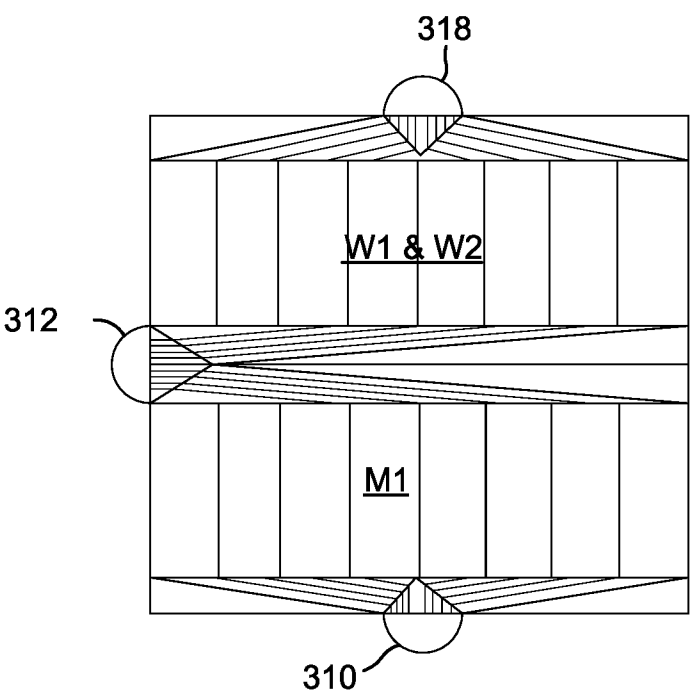
FIGS. 7A and 7B illustrate a preferred heat exchange passage configuration with additional design details regarding the preferred headers and distributors.
Figure 7A:
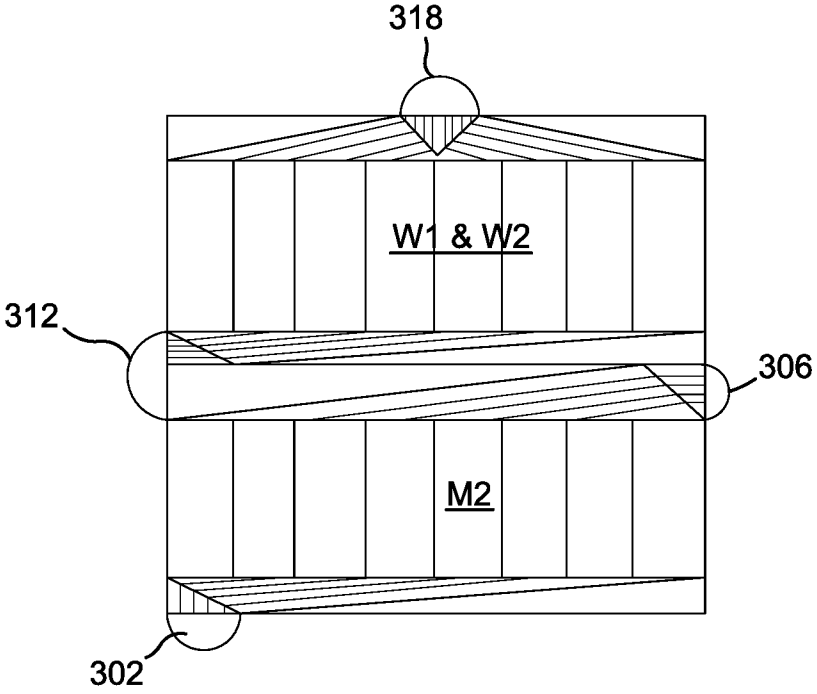

FIGS. 7A and 7B illustrate preferred heat exchange passage configurations with additional design details regarding the preferred headers and distributors. These FIGS. illustrate the flow path within the BAHX for the boiled LIN that passed from the BSSHX into M2 and for the nitrogen exhausted from the turbine that passes into M1 in a design operating in the second mode and for the remainder of the boiled LIN that passed from the BSSHX into M1 for a design operating in the first mode. Please note that FIG. 6, FIG. 7A, and FIG. 7B do not illustrate the flow or heat exchange configuration for the cooling natural gas streams to avoid an unnecessary complication. Ideally, the natural gas stream will occupy adjacent layers in both sections of the BAHX.

As seen in FIGS. 7A, and 7B, when operating in the second mode of operation, the nitrogen stream from the BSSHX is preferably directed to an end side header 302 for feed into the warming passages of the BAHX collectively identified as M2. A cold end blind flange 304 is disposed upstream of the BAHX in the cold end piping to prevent any of the nitrogen stream exiting the BSSHX to reach the warming passages in the BAHX collectively identified as M1. The cold end blind flange 304 essentially isolates the streams feeding warming passages M1 and M2 of the BAHX. Alternatively, the portion of piping depicted as containing the cold end blind flange could simply not be installed.

The warmed nitrogen vapor stream from warming passages M2 of the BAHX is withdrawn into the side header 306 and supplied to the turbine (not shown) where the stream is expanded. The expanded turbine exhaust stream 244 from the turbine is then fed into warming passages M1 of the BAHX 220 via the inlet, which may include a centrally disposed header and distributor 310. The warmed nitrogen vapor stream from warming passages M1 of the BAHX is withdrawn into the other side header 312 and returned into warming passages W1 and W2 of the BAHX 220. This other side header 312 is also referred to as a turnaround header. A warm end blind flange 314 is disposed proximate to or adjacent to the turnaround header and prevents any external flows from entering the turnaround header 314 in the second mode of operation and prevents any internal flows from exiting the turnaround header 314. In lieu of the warm end blind flange, that section of piping could be eliminated for a design operating in this mode.

When operating the LNG production system in the first mode of operation, the cold end blind flange 304 is removed or not installed. The nitrogen stream from the BSSHX 230 is preferably distributed equally to the warming heat exchange passages M1 and M2 of the BAHX 220. The warmed nitrogen stream from the warming heat exchange passages collectively identified as M2 in the BAHX 220 are directed from one side header 306 of the BAHX to the other side header 312 rather than to the turbine in a piping section connecting locations designated as 241 in FIG. 5A and FIG. 6. The warm-end blind flange 314 is also removed or not installed for this first mode of operation so that the warmed stream from warming passages M2 within the BAHX exit the BAHX at the other side header 306 and returned to the BAHX at the turnaround header 312 where the warmed stream combines with the warmed stream from warming passage M1 of the BAHX. The combined stream is distributed or apportioned into the warming passages W1 and W2 of the BAHX 220 and exits via outlet header 318.

In both modes of operation, warming passages of the BAHX collectively identified as W1 and W2 contain a common or a combined stream. As a result, warming passages W1 and W2 would preferably be designed with the same heat transfer fin selections, UA values, etc. Hence, warming layers collecting each of the warming streams M1 and M2 are shown as combined streams W1 and W2 in FIGS. 7A and 7B.

As shown in Example 2 below, it is also preferable that the total number of layers for warming passages W1 and W2 is the same number of layers as the warming passages M1 and M2. Such arrangement would avoid the need for redistribution of the cooling natural gas flowing from the warm section of the BAHX to the Mid-Section of the BAHX. It is expected that good flow distribution is achievable between warming passages M1 and M2 in the BAHX and between warming passages W1 and W2 in the BAHX by properly selecting the number of layers and heat transfer fins, and properly designing the headers, distributors and associated piping. If needed, a flow restriction device could also be installed in the piping between the two cold end headers of the BAHX and/or between the two side headers of the BAHX. Examples of flow restriction devices include fixed orifices or adjustable trim valves.

The above-described nitrogen refrigeration system for small-scale or micro-scale production of LNG is well suited for use in modular form. Because the disclosed LNG production system enables the design flexibility of employing a turbine or not employing a turbine with little to no additional engineering costs and rapid project execution.

In order to take advantage of this modularity, the base LNG production system should be designed to handle the most probable LNG production rates, expected to be approximately 5,000 gallons per day (0.4 MMSCFD) to 15,000 gallons per day (1.2 MMSCFD). For customers having higher requirements for LNG production, the proposed solution would involve integrating two or more of the above-described modular LNG production systems instead of building a custom designed medium-scale LNG production plant. For example, a customer opportunity requiring about 20,000 gallons per day of LNG would likely use two modules.

Another possibility where the modularity of the presently disclosed LNG production system is advantageous is in situations where a customer grows in their LNG sales and would like to make more LNG product sometime after the initial installation of the original LNG production system. The presently disclosed LNG production modules are ideal for adding LNG capacity in modest increments.

The modular design of the small-scale or micro-scale LNG production system facilitates different design approaches that may be beneficial. For example, two modules can be configured so that a common turbine is servicing and coupled to both modules. In that case, the selected turbine should be capable of efficiently handling the wider range of flow conditions for the multi-module installation. Such arrangement with multiple modules serviced by a single turbine would provide advantages such as capital cost savings or higher efficiency compared to employing a separate turbine for each module. Alternatively, a multi-module installation may employ one or more turbines for some of the modules and no turbine for other modules, as such hybrid arrangement may be beneficial in some circumstances, particularly where the modules are added over time or the cost of liquid nitrogen varies over time.

It should also be pointed out that while it is anticipated that a given LNG production system installation at a given customer site is unlikely to be converted from a configuration employing a turbine to a configuration without a turbine, or vice-versa, such addition or removal of a turbine could easily be done during scheduled maintenance/refurbishment of the LNG production system, or in the event of turbine failure, or even in response to significant changes in the cost of liquid nitrogen.

With the use of blind flanges, as described above, the switching costs and lost production of converting from one configuration to the other configuration at a customer-site would likely be minor. Moreover, if it is anticipated that a customer may eventually desire or intends to changeover the LNG production system with or without the turbine during the expected lifetime of the installation at least once or perhaps even more frequently, the blind flanges could be replaced by one or more manual valves. For the ultimate flexibility, the LNG production system installation might include a turbine together with automatically controlled valves in order to swiftly change to and from turbine-based operation to a non-turbine based operation, as needed. In general, the use of blind flanges is preferred due to lower cost and the complete avoidance of valve leakage, the existence of which would create an efficiency penalty.

Example 1

The first example is a computer model simulation that seeks to compare and validate the optimum heat exchanger designs for the dual-mode LNG liquefier over an expected range of LNG applications.

In Table 1, relative liquid nitrogen flow rate and turbine pressures are shown for LNG production system designed for an application having different pressures of the natural gas feed, including a natural gas feed pressure of 100 psia and a natural gas feed pressure of 500 psia. Natural gas feed pressure is the most important state condition affecting the liquefier design and performance. Table 1 also shows the relative UA, normalized for flow to better represent the real heat transfer surface area required for each of the four design cases. Put another way, Table 1 represents the performance and heat exchanger UA requirement for the optimal or custom heat exchanger designs for the four selected cases. The optimal designs are defined such that each heat exchange section provides an optimal, but realistic temperature difference profile.

TABLE 1

LNG Liquefier with Liquid Nitrogen Refrigeration and Custom Heat Exchanger

| Design Case | NG Pressure (psig) | Relative Liquid$N_2$ Flow | Turbine inlet pressure | Turbine outlet pressure | Relative UA BSSHX | Relative UA BAHX (Mid-Section) | Relative UA BAHX (Warm Section) |
|---|---|---|---|---|---|---|---|
| Mode 1 (w/o Turbine) | 100 | 1.000 | — | — | 0.095 | 0.762 | |
| Mode 1 (w/o Turbine) | 500 | 0.947 | — | — | 0.115 | 0.300 | |

TABLE 1-continued

| LNG Liquefier with Liquid Nitrogen Refrigeration and Custom Heat Exchanger | | | | | | | |
|---|---|---|---|---|---|---|---|
| Design Case | NG Pressure (psig) | Relative $LiquidN_2$ Flow | Turbine inlet pressure | Turbine outlet pressure | Relative UA BSSHX | Relative UA BAHX (Mid-Section) | Relative UA BAHX (Warm Section) |
| Mode 2 (w/Turbine) | 100 | 0.883 | 80 psia | 23 psia | 0.083 | 0.490 | 0.485 |
| Mode 2 (w/Turbine) | 500 | 0.840 | 65 psia | 23 psia | 0.095 | 0.529 | 0.149 |

As seen in FIGS. 1 and 3 and discussed above, the BSSHX represents the cold section of the heat exchanger arrangement or the brazed stainless steel heat exchanger. The Mid-Section of the BAHX and the Warm Section of the BAHX represent portions of the warmer section of the heat exchanger arrangement or the brazed aluminum heat exchanger. The demarcation point between the Mid-Section of the BAHX and the Warm Section of the BAHX is the extraction point of the turbine feed stream, as denoted by 'M' heat exchange passages and 'W' heat exchange passages in the Figs. In the operating Mode 1 cases, configured without the turbine, there is no extraction point so the relative UA values for the BAHX represent combined values.

The simulated data shown in Table 1 suggests that the ideal or optimum heat transfer surface areas are highly variable among the four design cases. The relative UA for the BSSHX is relatively constant, but the relative UA for the total BAHX varies significantly, as does the relative UA between the mid-section of the BAHX and the warm section of the BAHX, which represents the ideal or optimum extraction point for the turbine feed stream. Also apparent from the data in Table 1 is that the design cases using lower pressure natural gas feed (i.e. 100 psig) require much greater BAHX surface area than the design cases using medium to higher pressure natural gas feed (i.e. about 500 psig). In operating Mode 2 where a turbine is employed, that excess surface area is in the warm section of the BAHX above the turbine takeoff point.

In Table 2 the flow normalized relative UA values are held constant for each heat exchange section as would be the case in a fixed or common heat exchanger design. Any performance compromise would be indicated by comparing the relative liquid nitrogen flows in Table 2 with that of the equivalent design case in Table 1, above. Note that the UA selections of each section were not made simply to overdesign the BAHX and eliminate any possibility of performance penalties. While these heat exchangers will be relatively small and inexpensive, the need for portability and low installation cost is anticipated with the selection of relatively low UA values. The total UA of 0.60 for the BAHX is below the optimal, custom design UAs for all but one of the cases in Table 1. The UA of 0.10 for the BSSHX approximates the average of the custom designed cases of Table 1, which is appropriate for the relatively invariant need.

TABLE 2

| LNG Liquefier with Liquid Nitrogen Refrigeration and Common Heat Exchanger | | | | | | | |
|---|---|---|---|---|---|---|---|
| Design Case | NG Pressure (psig) | Relative $LiquidN_2$ Flow | Turbine inlet pressure | Turbine outlet pressure | Relative UA BSSHX | Relative UA BAHX (Mid-Section) | Relative UA BAHX (Warm Section) |
| Mode 1 (w/o Turbine) | 100 | 1.001 | — | — | 0.10 | 0.60 | |
| Mode 1 (w/o Turbine) | 500 | 0.945 | — | — | 0.10 | 0.60 | |
| Mode 2 (w/Turbine) | 100 | 0.883 | 85.6 psia | 23 psia | 0.10 | 0.30 | 0.30 |
| Mode 2 (w/Turbine) | 500 | 0.840 | 65 psia | 23 psia | 0.10 | 0.30 | 0.30 |

Example 2

The second example is a computer model simulation that seeks to compare and validate whether a fixed heat exchanger design that is based, in part, on the optimum heat exchanger design characterized in Example 1 would perform acceptably in both the first mode of operation and the second mode of operation.

For the Mode 1 configurations, without a turbine or turbine extraction point, there is an insignificant increase in liquid nitrogen flow when the lower pressure natural gas feed (i.e. 100 psig) is used and an insignificant decrease in liquid nitrogen flow when the medium or higher pressure natural gas feed (i.e. 500 psig) is used. In other words, the choice of a common heat transfer surface area design for the low pressure natural gas case results in an insignificant penalty.

For the Mode 2 configurations, with a turbine and a defined turbine extraction point, the liquid nitrogen flow can be held constant for both the lower pressure natural gas feed (i.e. 100 psig) and the medium or higher pressure (i.e. 500 psig) design cases, indicating that there is no performance penalty. The shortage of heat transfer surface area for the lower pressure natural gas feed case shown in Table 2 compared to the corresponding optimal design case in Table 1 is compensated for by a minor increase in the turbine inlet pressure to increase its refrigeration output. This minor change in turbine inlet pressure will likely increase the speed of the turbine modestly, so it is likely to remain within the turbine design capabilities. The cost of raising the pump pressure to achieve the needed increase in turbine inlet pressure is virtually nil. On the other hand, if it happened that the design conditions were such that the increase in turbine inlet pressure could not be handled by the turbine design, only a modest penalty of 0.5% in liquid nitrogen flow would be required for a low natural gas feed pressure (relative flow of 0.887 instead of 0.883 in Table 2). This analysis shows that an effective, fixed or common heat exchanger design, without undesirable overdesign, can handle the expected range of LNG applications with minimal effect on system performance. This is a necessary capability for a singular designed system to be effective for both design modes.

While the present invention has been described with reference to a preferred embodiment or embodiments, it is understood that numerous additions, changes and omissions can be made without departing from the spirit and scope of the present invention as set forth in the appended claims.

What is claimed is:

1. A dual mode natural gas liquefier configured to operate in a first mode and a second mode, the dual mode natural gas liquefier comprising:

a heat exchanger having a plurality of cooling passages and a plurality of warming passages;

a natural gas inlet disposed on the heat exchanger and configured to receive a gaseous natural gas feed and distribute the natural gas through a plurality of cooling passages;

a natural gas outlet disposed on the heat exchanger and configured to discharge the liquefied natural gas from the heat exchanger;

a liquid nitrogen inlet disposed on the heat exchanger and configured to receive a liquid nitrogen feed and distribute the liquid nitrogen through a plurality of warming passages;

a gaseous nitrogen outlet disposed on the heat exchanger and configured to discharge the vaporized nitrogen from the heat exchanger;

wherein the heat exchanger is configured to liquefy the gaseous natural gas traversing the cooling passages via indirect heat exchange with nitrogen traversing the warming passages;

an intermediate outlet disposed on the heat exchanger and coupled to one or more of the plurality of warming passages and configured to divert a gaseous nitrogen stream passing through the one or more of the plurality of warming passages;

a first intermediate inlet disposed on the heat exchanger and configured to receive the diverted gaseous nitrogen stream when operating in the first mode and;

a turbine configured to expand the diverted gaseous nitrogen stream when the dual mode natural gas liquefier is operating in the second mode and produce a turbine exhaust stream that is at a temperature that is less than the temperature of the diverted gaseous nitrogen stream;

a second intermediate inlet disposed on the heat exchanger and configured to receive the turbine exhaust when the dual mode natural gas liquefier is operating in the second mode and configured to be blocked by one or more blind flanges when the dual mode natural gas liquefier is operating in the second mode;

wherein when the dual mode natural gas liquefier is configured to operate in the first mode, the intermediate outlet is in fluid communication with the first intermediate inlet and the diverted gaseous nitrogen stream is reintroduced to warming passages within the heat exchanger via the first intermediate inlet with the reintroduced nitrogen stream at a temperature that is equal to or greater than the temperature of the diverted gaseous nitrogen stream; and wherein when the dual mode natural gas liquefier is configured to operate in the second mode, the turbine exhaust stream is reintroduced to warming passages within the heat exchanger.

2. The dual mode natural gas liquefier of claim 1, wherein the heat exchanger includes a cold section, a mid-section and a warm section; and wherein the natural gas inlet and the nitrogen outlet are disposed on the warm section of the heat exchanger, the liquefied natural gas outlet and the liquid nitrogen inlet are disposed on the cold section of the heat exchanger, and the intermediate outlet, the first intermediate inlet and the second intermediate inlet are disposed on the mid-section of the heat exchanger.

3. The dual mode natural gas liquefier of claim 2, wherein the second intermediate inlet is disposed between the cold section of the heat exchanger and the mid-section of the heat exchanger.

4. The dual mode natural gas liquefier of claim 2, wherein the intermediate outlet is disposed between the mid-section of the heat exchanger and the warm section of the heat exchanger.

5. The dual mode natural gas liquefier of claim 2, wherein the first intermediate inlet is disposed between the mid-section of the heat exchanger and the warm section of the heat exchanger.

6. The dual mode natural gas liquefier of claim 1, wherein the heat exchanger includes two or more separate heat exchangers, including a cold heat exchanger and a warm heat exchanger;

wherein warming passages of the cold heat exchanger are in fluid communication with warming passages of the warm heat exchanger and cooling passages of the cold heat exchanger are in fluid communication with cooling passages of the warm heat exchanger;

wherein the liquefied natural gas outlet and the liquid nitrogen inlet are disposed on the cold heat exchanger; and wherein the natural gas inlet and the nitrogen outlet are disposed on the warm heat exchanger.

7. The dual mode natural gas liquefier of claim 6, wherein the cold heat exchanger is a brazed stainless steel heat exchanger and the warm heat exchanger is a brazed aluminum heat exchanger.

8. The dual mode natural gas liquefier of claim 6, wherein the cold heat exchanger is a stainless steel spiral wound heat exchanger and the warm heat exchanger is a brazed aluminum heat exchanger.

9. The dual mode natural gas liquefier of claim 6, wherein the second intermediate inlet is disposed between the cold heat exchanger and the warm heat exchanger.

10. The dual mode natural gas liquefier of claim 6, wherein the intermediate outlet is disposed at an intermediate location of the warm heat exchanger.

11. The dual mode natural gas liquefier of claim 6, wherein the first intermediate inlet is disposed at an intermediate location of the warm heat exchanger.

12. The dual mode natural gas liquefier of claim 6, further comprising a separator configured to remove natural gas liquid (NGL) contaminants from the natural gas, the separator disposed upstream of and in fluid communication with the natural gas inlet or disposed between the cold heat exchanger and the warm heat exchanger.

13. The dual mode natural gas liquefier of claim 1, wherein the turbine comprises an air bearing turbine.

14. The dual mode natural gas liquefier of claim 1, wherein the turbine further comprises a turbine having an expansion ratio of between 2.0 and 4.0.

15. The dual mode natural gas liquefier of claim 1, further comprising:

a liquid nitrogen storage tank in fluid communication with the liquid nitrogen inlet and configured to supply the liquid nitrogen feed; and a liquified natural gas storage tank in fluid communication with the liquified natural gas outlet and configured to hold the liquified natural gas produced by the dual mode natural gas liquefier.

16. The dual mode natural gas liquefier of claim 1, further comprising a pump disposed upstream of and in fluid communication with the liquid nitrogen inlet, the pump configured to raise the pressure of the liquid nitrogen feed.

17. The dual mode natural gas liquefier of claim 1, further comprising a natural gas compressor disposed upstream of and in fluid communication with the natural gas inlet, the natural gas compressor configured to raise the pressure of the natural gas feed.

* * * * *